United States Patent [19]

Shuck

[11] 4,279,299

[45] Jul. 21, 1981

[54] APPARATUS FOR INSTALLING CONDITION-SENSING MEANS IN SUBTERRANEAN EARTH FORMATIONS

[75] Inventor: Lowell Z. Shuck, Morgantown, W. Va.

[73] Assignee: The United States of America as represented by the United States Department of Energy, Washington, D.C.

[21] Appl. No.: 101,370

[22] Filed: Dec. 7, 1979

[51] Int. Cl.[3] ..... E21B 47/06

[52] U.S. Cl. ..... 166/60; 166/250; 166/277

[58] Field of Search ..... 166/60, 162, 244 C, 166/277, 99, 170, 222, 223, 250; 73/151; 33/304; 175/52

[56] References Cited

U.S. PATENT DOCUMENTS

| | | | |
|---|---|---|---|
| 2,286,075 | 6/1942 | Evans | 166/277 |
| 2,599,405 | 6/1952 | Mennecier | 175/52 |
| 2,608,002 | 8/1952 | Bielstein | 175/52 |
| 2,826,077 | 3/1958 | Walker | 166/170 |
| 3,301,337 | 1/1967 | Vaughn et al. | 175/52 |
| 3,750,748 | 8/1973 | Kinley et al. | 166/277 |

*Primary Examiner*—James A. Leppink

*Attorney, Agent, or Firm*—Earl L. Larcher; Stephen D. Hamel; Richard G. Besha

[57] ABSTRACT

The present invention is directed to an apparatus for installing strain gages or other sensors-transducers in wellbores penetrating subterranean earth formations. The subject apparatus comprises an assembly which is lowered into the wellbore, secured in place, and then actuated to sequentially clean the wellbore or casing surface at a selected location with suitable solvents, etchants and neutralizers, grind the surface to a relatively smooth finish, apply an adhesive to the surface, and attach the strain gages or the like to the adhesive-bearing surface. After installing the condition-sensing gages to the casing or earth formation the assembly is withdrawn from the wellbore leaving the sensing gages securely attached to the casing or the subterranean earth formation.

7 Claims, 6 Drawing Figures

APPARATUS FOR INSTALLING CONDITION-SENSING MEANS IN SUBTERRANEAN EARTH FORMATIONS

BACKGROUND OF THE INVENTION

The present invention relates generally to an apparatus for installing condition-sensing mechanisms in remote locations, and more particularly to such an apparatus for installing strain gages and the like at selected locations within a wellbore penetrating a subterranean earth formation.

The recovery of energy values contained in subterranean earth formations, such as gas and oil-bearing sandstone and shale, geothermal formations, coalbeds and the like, is frequently achieved by penetrating the energy-bearing strata with strategically placed wellbores. In the recovery of these energy values through the wellbores such as achieved by the in situ combustion of coal and the primary through tertiary recovery of petroleum products, it is often desirable to monitor various conditions occurring in the subterranean earth formation which may in some manner affect the efficiency of the recovery operation. For example, the presence of strain gages in the subterranean earth formation would be of considerable value to measure strain such as caused by subsidence, formation shifting, pressure variations, or strains such as caused by the injection of fluids for enhanced oil recovery purposes or for fracturing the earth formation and monitoring effects of the same in adjacent wellbores. The monitoring of strain, temperature and pressures in subterranean earth formations is of considerable value in the recovery of energy values. For example, installing such transducers either in the "open" uncased wellbore or on the casing can be useful in evaluating research or production reservoirs through various tests. As another example, the early detection of potentially deleterious conditions in the strata adjacent the wellbore can be utilized to prevent the loss or downtime of the wellbore due to the fracturing of the casing or the displacement or breakage of other equipment contained within the wellbore. Also fracturing pressures, casing stability in situ stress and strain and their gradient changes from either local wellbores or regional activities, such as mining or fluid production or injection can be closely monitored to increase the efficiency of the energy recovery operation.

BRIEF DESCRIPTION OF THE INVENTION

It is a primary objective, or goal, of the present invention to provide an apparatus which can be utilized to install various condition-sensing means at selected locations within a wellbore penetrating a subterranean earth formation. The apparatus for accomplishing this and other objectives generally comprises an elongate housing adapted to be selectively positioned within the wellbore. Means are carried by the housing for attaching the housing to the walls of the wellbore or a casing therein at a selected location. Liquids contained in pressurized cells in the housing are utilized to clean an encompassing or annular surface portion of the earth formation or the casing therein. A rotatable grinding mechanism supported by the housing is engagable upon rotation thereof with the aforementioned surface portion to grind surface contaminants, such as oxides, therefrom as well as provide the casing or earth formation with a relatively smooth surface. After spraying the liquids contained in the housing and grinding the wall of the wellbore to the desired smoothness, a suitable adhesive is sprayed thereon. Alternatively, following the surface preparation the condition-sensing means may be attached by employing another fastening technique such as spot welding or the like that is appropriate for the condition sensor and the bore hole substance and its chemical, and mechanical properties. The condition-sensing means which are supported by the housing with laterally displaceable means are caused to bear against the clean wall portion so as to securely attach the condition-sensing means to the wall surface. After the installation of the condition-sensing means the sensor-installing apparatus is withdrawn from the wellbore leaving the condition-sensing means fixed in place within the wellbore.

With the condition-sensing means which may include strain gages, seismic and electrical probes, acoustic emission, crack propagation gages, thermocouples and thermisters or other temperature sensors, displacement transducers, and the like attached at the desired location within the wellbore, various conditions or events occurring within the subterranean earth formation can be monitored and measured. This "downhole" data can be advantageously employed in the recovery of the energy values contained in the earth formation or be utilized to prevent conditions from occurring in the earth formation which may interrupt such recovery and require emergency measures or other costly repairs including the redrilling of new wellbores.

Other and further objects of the invention will be obvious upon an understanding of the illustrative embodiment about to be described or will be indicated in the appended claims, and various advantages not referred to herein will occur to one skilled in the art upon employment of the invention in practice.

A preferred embodiment of the invention has been chosen for the purpose of illustration and description. The preferred embodiment illustrated is not intended to be exhaustive or to limit the invention to the precise form disclosed. It is chosen and described in order to best explain the principles of the invention and their application in practical use to thereby enable others skilled in the art to best utilize the invention in various embodiments and modifications as are best adapted to the particular use contemplated.

DETAILED DESCRIPTION OF THE INVENTION

Figures 1, 6:
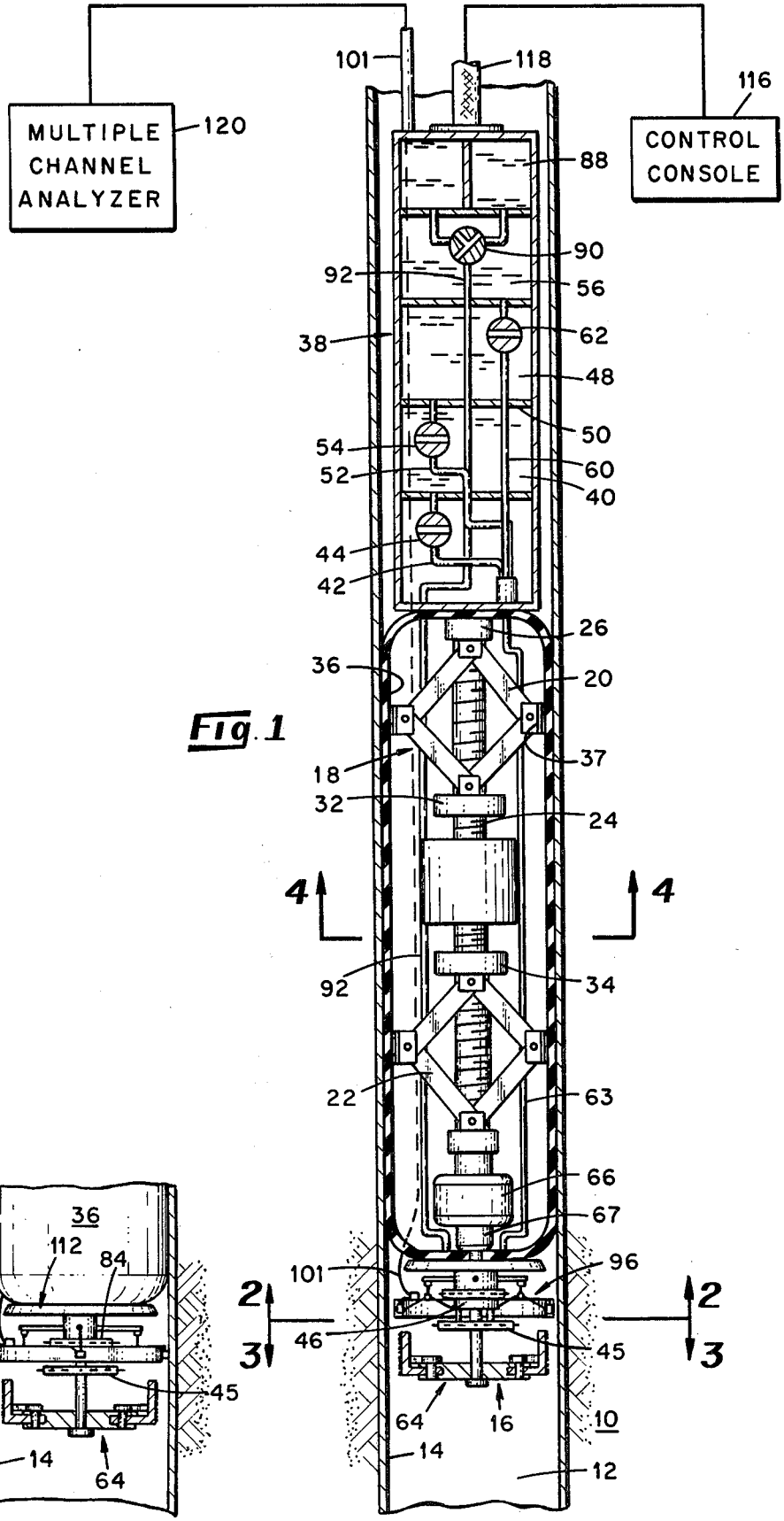
FIG. 1 is an elevational view partially sectioned and broken away showing the sensor-installing assembly of the present invention disposed within a cased wellbore penetrating a subterranean earth formation.
FIG. 6 is a fragmentary elevational view showing the sensors as they would appear when displaced against the casing of the wellbore prior to the withdrawal of the sensor-installing assembly from the wellbore.

With reference to the accompanying drawings an earth formation 10 is penetrated by a wellbore 12 lined with an optional casing 14 in a conventional manner. As shown in FIG. 1, the sensor-installing assembly 16 of the present invention is positioned at a desired location within the wellbore 12 for applying appropriate condition-sensing means to the inner wall surface of the casing 14 for monitoring and measuring conditions or occurrences within the casing or wellbore and the surrounding earth strata.

The sensor-installing assembly 16 is secured and maintained in the selected position in the wellbore or the casing by an attaching mechanism 18 of any suitable type. For example, as shown in drawing, the assembly 16 is secured to the casing 14 by a screw jack type restraint which comprises a pair of spaced-apart screw jacks 20 and 22 which are moved radially inwardly or outwardly by the rotation of a lead screw 24. Suitable bearings 26 and 28 at the ends of the lead screw 24 permit rotation of the lead screw 24 within the screw jacks 20 and 22 without rotating the latter so as to affect the radial movement thereof. The rotation of the lead screw 24 is achieved in any suitable manner such as by a centrally located reversible servo or electric motor 30 with suitable gear reducers 32 and 34 on the opposite sides thereof for displacing the screw jacks 20 and 22. These gear reducers may be of any suitable reduction in the range of about 10 to 50:1.

A rubber boot 36 encases the attaching mechanism 18 for facilitating the engagement of the screw jacks with the casing wall. By attaching the rubber boot 36 to the centering blocks 37 at the radially outermost ends of the screw jacks the latter are assured of radial movement without rotation for securing the sensor-installing assembly 16 to the casing 14. If desired, suitable pads (not shown) may be placed on the outside of the boot 36 opposite the centering blocks 37 to provide an even more secure attachment to the walls in the wellbore especially if casing is not utilized.

While the screw jack and boot arrangement as above described functions satisfactorily for the purpose of fixedly securing the sensor-installing assembly to the casing or wellbore walls, an inflatable rubber boot or any other suitable mechanism capable of fixedly securing the sensor-installing assembly in the wellbore may be utilized.

The sensor-installing assembly 16 includes a plurality of pressurizable liquid containers or cells disposed in a stacked arrangement for providing individual compartments for housing suitable liquids utilized for the aforementioned cleaning and sensor-bonding operations. As shown in FIG. 1, the stacked liquid containers 38 comprise a solvent compartment 40 containing acetone, toluene, carbon tetrachloride or any other solvent capable of dissolving petroleum and other residue of such a soluble nature from the surface of the casing 14 or the subterranean earth formation. This solvent is delivered from the compartment 40 through a conduit 42 containing a valve 44 to an annular spray ring 45 affixed to the boot 36 by an annular support member or boss 4. To effect the discharge of the solvent and other stored liquids from the compartments to the point of use, the compartments may be pressurized with a suitable fluid medium. The spray ring 45 is fixedly disposed on the sensor-installing assembly at a location below the boot 36 and is provided with the plurality of radially extending outlets 47 disposed about the circumference of the ring so as to ensure a uniform distribution of the solvent over the surface of the wall of the encompassing casing 14 or the subterranean earth formation 10. Next to the solvent compartment 40 is a compartment 48 containing an etchant. This compartment 48 may be satisfactorily separated from the solvent compartment 40 by a suitable partition such as shown at 50. The other fluid compartments may be similarly separated from one another. An etchant, such as HCl or the like, is conveyed from compartment 48 to the spray ring 45 by a conduit 52 containing a valve 54. A compartment 56 containing a neutralizer, such as ammonia or the like, is disposed next to the etchant compartment 48. The neutralizing liquid is conveyed through a conduit 60 containing a valve 62 to the spray ring 45 for neutralizing the etchant previously sprayed onto the surface of the encompassing casing 14 or the earth formation. The conduits 42, 52, and 60 may be merged into a single conduit such as shown at 63 at a location near the top of the lead screw 24 to facilitate the conveyance of the liquids through the boot 36 to the spray ring 45. Also, if desired, the positions of screw jack and boot arrangement and the stacked liquid compartments may be reversed with the drive motor for the grinding mechanism, as will be described below, disposed outside the boot 36.

Figure 3:
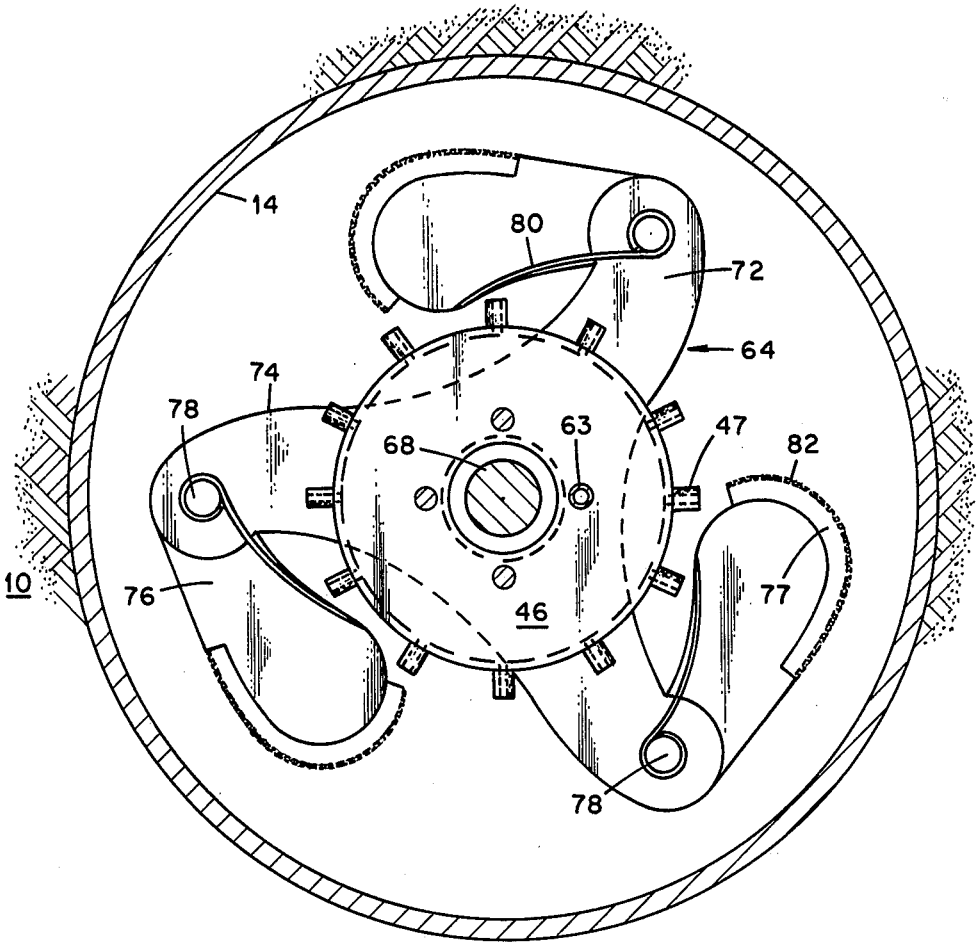
FIG. 3 is an enlarged plan view taken along line 3—3 of FIG. 1 showing details of the centrifugally actuated grinding mechanism of the present invention which is utilized to provide a smooth relatively clean surface of the earth formation or the casing lining the wellbores and details of the spray ring utilized to spray selected liquids onto the surface of the casing or wellbore.

Prior to contacting the casing with the solvent, etchant and neutralizer solutions, the surface of the casing 14 at the location selected for the attachment of the sensors may be contacted with a grinding mechanism generally shown at 64 for removing excess surface contaminants and for providing the casing with a relatively smooth surface at that location. The grinding mechanism 64 is rotated by a drive motor 66 through a suitable gear reducer 67 and a shaft 68. If desired, suitable bearings may be placed in the boot 36 and spray rings to support and facilitate the rotation of the shaft 68. The grinding mechanism 64 as best shown in FIG. 3 comprises a circumferentially recessed disc 72 to which a plurality of grinding heads 76 are attached and rest within the recesses 74. As in FIG. 3, three such grinding heads 76 are shown but any suitable number may be utilized. Each grinding head 76 is provided with vertically extending flanges 77 and are attached to the disc 72 by suitable pins 78 about which the grinding heads pivot. These flanged grinding heads 76 move outwardly against the bias or restraint of tension springs 80 when the disc 72 is rotated by the motor 66 so as to bring the grinding heads into contact with the surface of the casing 14.

The grinding heads 76 are provided with abrasive grinding pads 82 which may be composed of diamond or tungsten carbide grit so as to provide the desired abrasiveness for facilitating the grinding operation. Upon the cessation of the rotation of the disc 72, the springs 80 return the grinding heads 76 to their nesting position within the disc recesses 74. The grinding heads 76 are preferably provided with suitable radiuses at the surface of the grinding pads 82 so that the grinding mechanism can be used in wellbores with about 2 inches difference in diameter.

After cleaning and grinding the casing 14 with the grinding and the cleaning steps being repeated as often as deemed necessary, the "downhole" sensors may be securely attached to the casing surface. To effect this attachment the screw jacks 20 and 22 are retracted and the entire sensor-installing assembly 16 is lowered into the wellbore a distance of about 2 to 3 inches so as to place the sensing elements in a position immediately adjacent the cleaned and ground surface on the casing 14. When in this position the screw jacks 20 and 22 are expanded to again secure the assembly 16 within the casing 14. An adhesive of any suitable type may then be sprayed onto the casing 14 through a spray ring 84 disposed between the spray ring 45 and the boot 36. This spray ring 84 may be constructed in a manner similar to the spray ring 45 used for spraying the solvent, etchant and neutralizer solutions. This adhesive may be epoxy which may be contained in a twocompartment arrangement, one for the resin and the other for the hardener. This two-cell compartment 88 is provided with conduits passing through a three-way valve 90 into a conduit 92 for conveying the mixed adhesive to the spray ring 84.

Figure 4:
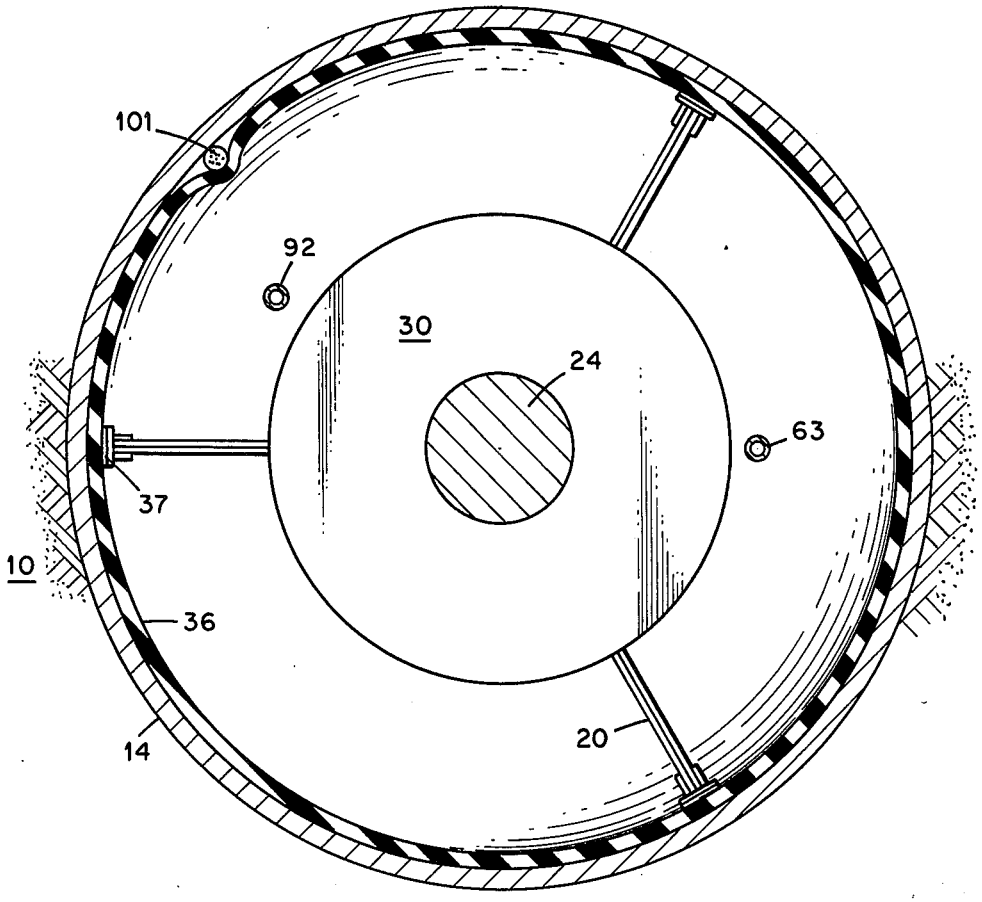
FIG. 4 is an enlarged plan view taken along line 4—4 of FIG. 1 illustrating the inflatable boot and scissor mechanism utilized to hold the sensor-installing assembly within the wellbore.

After the adhesive is applied to the clean surface of the casing the condition-sensing means generally shown at 96 are brought into an abutting relationship against the adhesive-coated casing 14 for effecting the secure attachment of the sensing means to the surface of the casing 14. These sensing means may be of any suitable type utilized for conveying information to the surface of the wellbore for a desired purpose. For example, strain gages, temperature sensors, transducers, pressure sensors, transponders, and the like, may be attached to the surface of the casing 14 by employing the apparatus of the present invention. For the purpose of this illustration the sensing means are shown as strain gages 98 which are provided with a wiring harness 100 to form a rosette of four strain gages 78 disposed about the inner circumference of the casing 14. While four strain gages 98 are shown it will appear clear that any suitable number of sensors, ranging from one to a plurality thereof, may be utilized. The wiring harness 100 is attached through to a lead wire 101 projecting to the surface of the bore hole on the outside of the boot 36 as shown in FIG. 4. A suitable amplifying system, not shown, may be attached near the strain gages 98 to enhance the signal quality and amplitude. Alternatively, the information from the sensors 98 may be transmitted to above ground by acoustic or electric pulses so as to negate the use of the cables in the wellbore.

Figure 2:
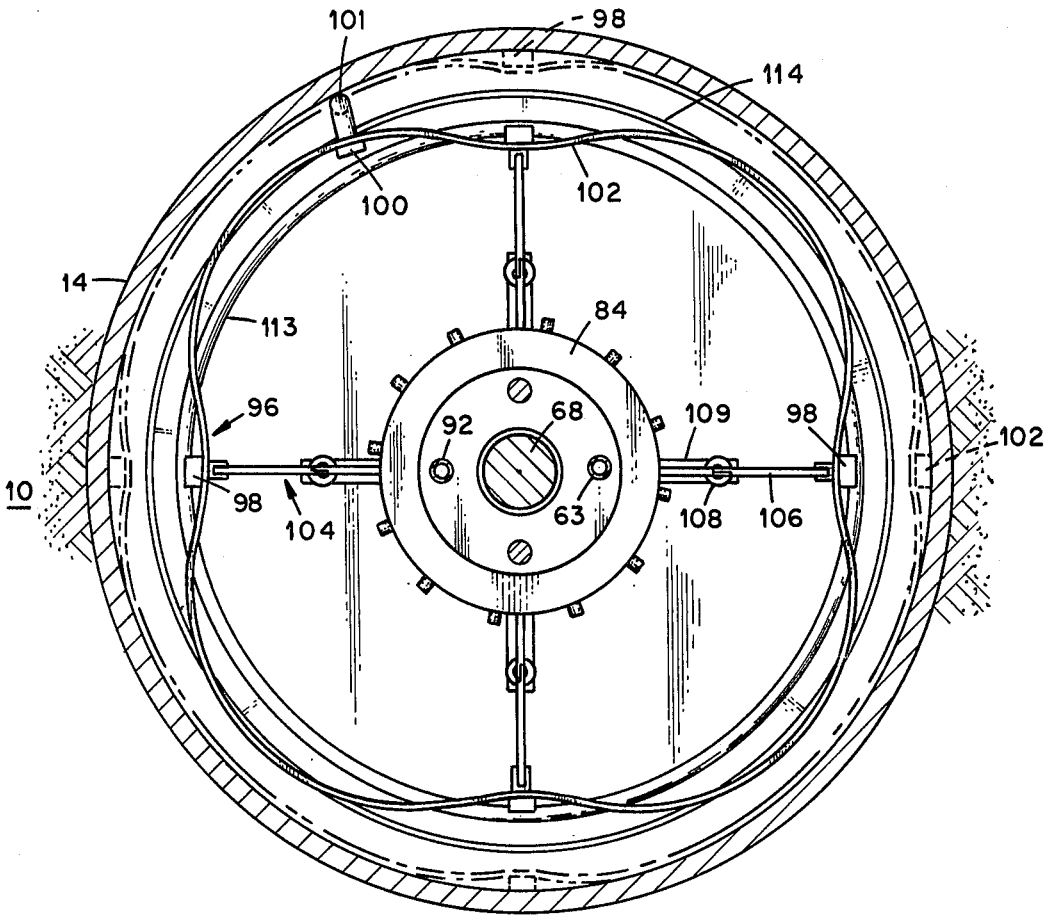
FIG. 2 is an enlarged plan view taken along line 2—2 of FIG. 1 showing details of the condition sensors as disposed and supported by the installing assembly prior to their engagement with the casing.
Figure 5:
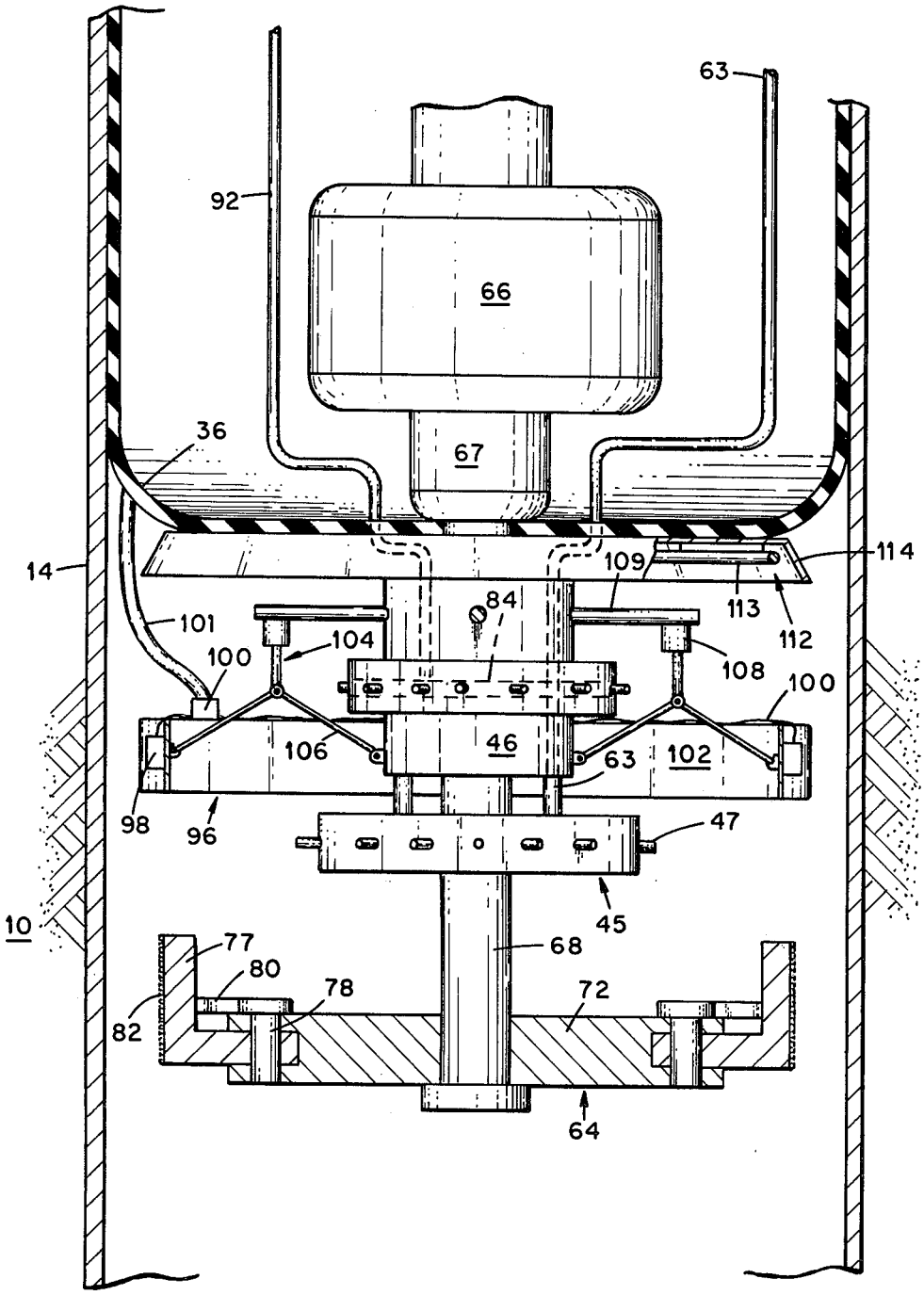
FIG. 5 is an enlarged fragmentary elevational view showing details of the sensor-installing assembly.

The strain gages 98 are supported by an anchor band 102 formed of a spring-like material such as epoxy, fiberglass or bakelite and in an annular configuration of an outer diameter slightly less than the inner diameter of the casing 14. This spring-like anchor band 102 which continuously seeks to move into its preset circular configuration is held in a convoluted or warped configuration to a diameter less than its maximum diameter for facilitating its insertion into the wellbore. This constraint on the anchor band 102 is provided by a wire or jointed metal couplings 104, four of which are shown. Each of these couplings 104 comprises a wire or metal jointed arm 106 which is fastened to the anchor band 102 in a suitable breakaway joint and extends to the centrally disposed spray ring support boss 46. The movement of the jointed arms 106 is controlled by solenoids 108 which are supported on projections 109 extending from the boss 46. When the arms 106 are in an arched or bent configuration as shown in FIG. 5 portions of the anchor band 102 are restrained radially inwardly to provide the anchor band with the desired convoluted state (FIG. 2). Upon release or actuation of the solenoids 108, the anchor band 102 snaps into its natural annular configuration to force the strain gages 98 against the adhesive-bearing surface of the casing 14. As previously mentioned, the joinder of the coupling 104 to the anchor band 102 is made relatively weak with respect to that of the adhesive bond between the anchor band 102 to the casing 14 so that the sensor-installing assembly 16, after completing the positioning of the anchor band and the strain gages carried thereby on the casing, can be readily withdrawn from the casing 14 by breaking the coupling 104 and thereby leaving the sensors 98 and the anchor band 102 in place.

While the anchor band 102 is holding the strain gages 88 against the adhesive or the surface of the casing as in FIG. 6, a heater as generally shown at 112 may be activated for facilitating the curing of the adhesive. The heater 112 may be provided by an annular wire 113 of Nichrome or any other suitable resistance heating material. An annular cupped shield 114 is preferably positioned above the heater wire 113 for reflecting the heat towards the casing and away from the boot 36. In the event sufficient heat is present in the earth formation to cure the adhesive in a reasonable time the heater or at least the heating cycle may be eliminated. Also, if desired, the heater may be used to dry the casing or wellbore after the application of any of the solvent, etchant, or neutralizer.

To selectively position the sensor-installing assembly 16 within the wellbore and to provide the actuation of the various mechanisms of the assembly 16 a suitable control console 116 is disposed at the wellbore surface. This console is coupled to the sensor-installing assembly 16 through a conventional logging steel armored cable 118 which may be utilized for raising and lowering the assembly 16 as well as conveying the necessary function signals.

Upon completion of the attachment of the strain gages 98 on the casing surface, the sensor-installing assembly 16 is withdrawn from the wellbore leaving the anchor band 102 in place on the casing as well as the lead wire 101 projecting from the strain gages to the surface. This lead wire 101 may be coupled to a suitable multiple-channel analyzer or data-acquisition system as generally shown at 120.

The circuitry utilized for controlling the various valves, heater, motors and solenoids is not shown but may be of any suitable design.

In order to provide a more facile understanding of the present invention a typical operation utilized for installing a strain gage rosette to a wellbore casing is set forth below.

The sensor-installing assembly 16 is lowered to a desired location within the wellbore casing 14. The screw jacks 20 and 22 are extended to secure the assembly 16 in the casing 14. The casing 14 is then sequentially sprayed with degreaser, etchant, and a deoxidizer or neutralizer. Upon completing the application of the surface-cleaning solutions to the casing 14, the casing surface is ground with the centrifugally operated grinding mechanism 64. The application of the liquids and the grinding step may be achieved and repeated in any suitable sequence depending upon the condition of the wellbore or casing surface. The position-locking mechanism (screw jacks) is then reactivated and the sensor-installing assembly 16 lowered approximately 2 or 3 inches into the wellbore 12 to align the strain gages 98 and the anchor band 102 with the clean and ground surface of the casing. The clean casing wall is then sprayed with the adhesive and the solenoids 108 are energized to permit the anchor band 102 to assume its natural annular configuration to force the strain gages 98 against the wall surface of the casing 14 with a sufficient pressure, e.g., about 15 psi, to assure that the strain gages 98 are maintained in an abutting relationship with the casing 14 during the curing of the adhesive. The heat-curing cycle is then initiated to firmly attach the strain gages 98 to the casing wall. The screw jacks 20 and 22 are then reactivated and the sensor-installing assembly 16 is withdrawn from the wellbore breaking or otherwise releasing the couplings 104 from the anchor band 102. With the strain gages 98 in place in the wellbore, suitable signals representative of various wellbore conditions may be relayed to the analyzer 120 for facilitating experimentation and monitoring to enhance the recovery of energy products from the subterranean earth formation 10.

It will be seen that the present invention provides a relatively simple mechanism for installing condition-sensing mechanisms in remote locations especially those within a wellbore penetrating an earth formation. The utilization of these sensors at such locations will greatly facilitate the recovery of various energy values from subterranean earth formations. Also, the harness or flexible ring containing strain gages or other sensors may also include down hole power supplies (battery) microprocessor data reduction, conversion, and transmission of data from the subterranean formation of interest or demand of signals from above ground, or at predetermined intervals, or at predetermined signal level or characteristics. The transmission of the signal and data may be by cable or digitally coded and transmitted acoustically through either the borehole fluid or casing.

What is claimed is:

1. An apparatus for emplacing condition-sensing means at a selected location within a wellbore penetrating a subterranean earth formation, housing means adapted to be selectively positioned within the wellbore, means carried by said housing means for securing and maintaining the housing means at the selected location, grinding means carried by said housing and engagable upon the rotation thereof with an encompassing wall surface at said location, means for rotating said grinding means, container means carried by the housing means for storing liquid agents, spraying means coupled to the container means and carried by the housing means at a location adjacent said grinding means for spraying the liquid agents onto said wall surface at said location, condition-sensing means, displaceable means carried by the housing means for supporting the sensing means, and means for actuating the displaceable means to place the sensing means in an abutting relationship with said wall surface.

2. The apparatus claimed in claim 1, wherein said grinding means comprises a disc rotatable about an axis, a plurality of grinding heads pivotably carried by said disc wherein the rotation of said disc about said axis radially displaces the grinding heads to bear against said wall surface, and wherein bias means are coupled to said grinding heads for maintaining the grinding heads at a location spaced from said wall surface when the disc is at rest.

3. The apparatus claimed in claim 1, wherein the container means comprises a plurality of chamber means for discretely storing liquid agents including a solvent, etchant, and neutralizer for cleaning and preparing said wall surface for the reception of said sensing means and further including an adhesive for bonding said sensing means to said wall surface, wherein conduit means couple each of said chamber means to said spraying means, and wherein selectively actuatable valve means are associated with the conduit means for selectively spraying the liquid agents on said wall surface at said location.

4. The apparatus claimed in claim 4, wherein said spraying means comprises first and second spray rings vertically spaced apart from one another and each having a plurality of circumferentially spaced apart outlets, wherein certain of said conduit means couple said first spray ring to the chamber means containing the solvent, etchant and neutralizer, and wherein other of said conduit means couples said second spray ring to the chamber means containing the adhesive.

5. The apparatus claimed in claim 1, wherein said displaceable means comprises an annulus of spring-like material of a diameter sufficient to bear against the encompassing wall surface, wherein the sensing means are disposed on the outer surface of the annulus, and wherein the means for actuating the displaceable means maintain the annulus at a diameter insufficient to contact the encompassing wall surface prior to the actuation of the displaceable means.

6. The apparatus claimed in claim 1, wherein the sensing means comprise a plurality of strain gages disposed on the radially outermost surface of said displaceable means at circumferentially spaced-apart locations, and wherein said strain gages are coupled to signal analyzing means at the surface of said earth formation.

7. The apparatus claimed in claim 1, wherein selectively actuatable heat-providing means are disposed adjacent to said displaceable means to heat said wall surface at said location.

* * * * *